US006051817A

United States Patent [19]

Mörsch et al.

[11] Patent Number: 6,051,817

[45] Date of Patent: Apr. 18, 2000

[54] HEATING CONDUCTOR FOR RADIANT HEATING BODIES OF A COOKING HOB

[75] Inventors: Norbert Mörsch, Wangen; Jörg Meyer, Ratzenried, both of Germany

[73] Assignee: AKO-Werke GmbH & Co. KG, Wangen, Germany

[21] Appl. No.: 09/089,896

[22] Filed: Jun. 3, 1998

[51] Int. Cl.[7] ..... H05B 3/68; H05B 3/16

[52] U.S. Cl. ..... 219/460.1; 219/461.1; 219/542

[58] Field of Search ..... 219/460.1, 461.1, 219/462.1, 465.1, 466.1, 467.1, 468.2, 541, 542; 338/279, 280, 281

[56] References Cited

U.S. PATENT DOCUMENTS

| | | | |
|---|---|---|---|
| 3,567,906 | 3/1971 | Hurko | 219/466.1 |
| 4,034,206 | 7/1977 | Penrod | 219/461.1 |
| 4,161,648 | 7/1979 | Goessler | 219/461.1 |
| 5,753,892 | 5/1998 | Gross et al. | 219/461.1 |

FOREIGN PATENT DOCUMENTS

| | | |
|---|---|---|
| 0 175 662 | 3/1986 | Germany . |
| 0 229 928 | 7/1987 | Germany . |
| 0 585 538 A1 | 3/1994 | Germany . |
| 42 29 375 A1 | 3/1994 | Germany . |

*Primary Examiner*—Sang Paik
*Attorney, Agent, or Firm*—Scully, Scott, Murphy & Presser

[57] ABSTRACT

There is proposed a heating conductor for a radiant heating body of a cooking hob, which is substantially formed from heating limbs (2) which are cut out of a metal foil or sheet in a geometrical pattern and inserted between the cooking hob and an insulating bottom (20). The heating limbs (2) have holding tongues (1) for fixing the heating limbs in holding portions (5) of the radiant heating body or in portions of the insulating bottom (20). The holding tongues (1) have substantially integrated fixing devices. Also described are certain advantageous arrangements and configurations of the heating conductors.

26 Claims, 6 Drawing Sheets

Figure 1:
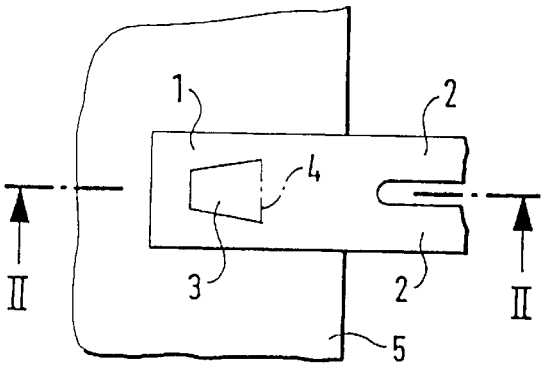

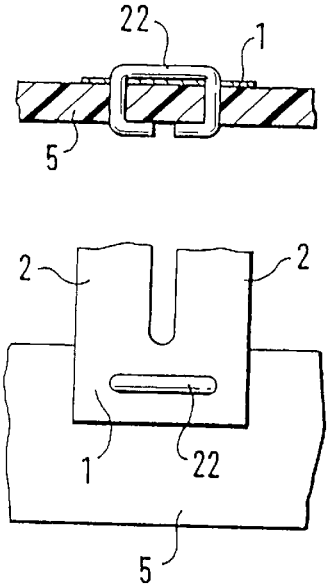
FIG. 11
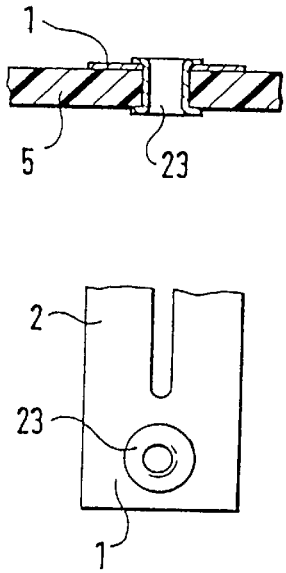
FIG. 12
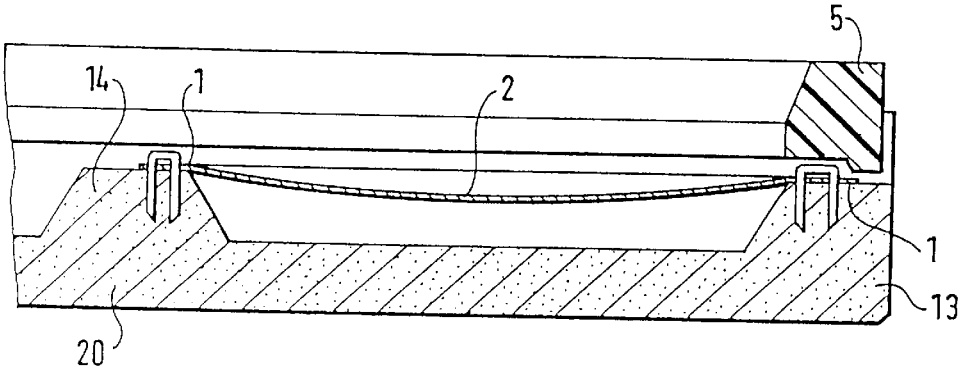
FIG. 13
FIG. 14
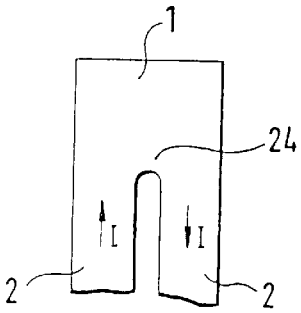
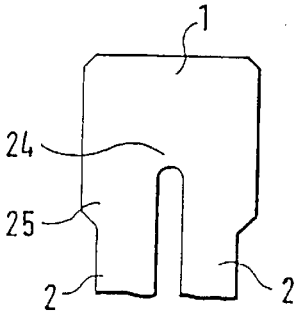
FIG. 15

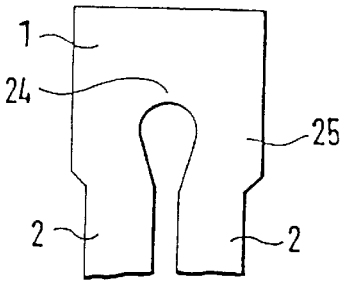
FIG. 16
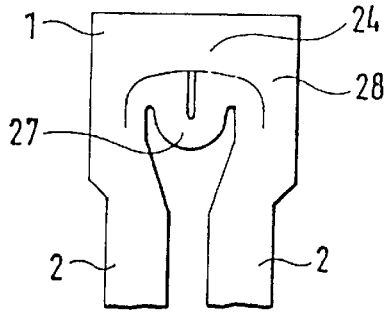
FIG. 18
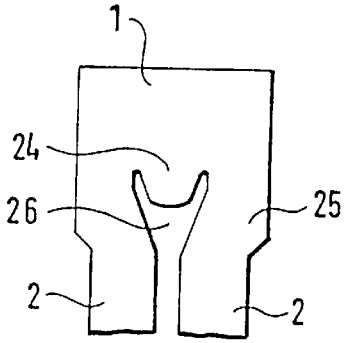
FIG. 17
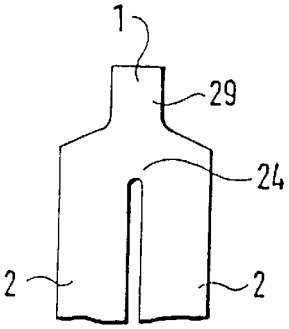
FIG. 19
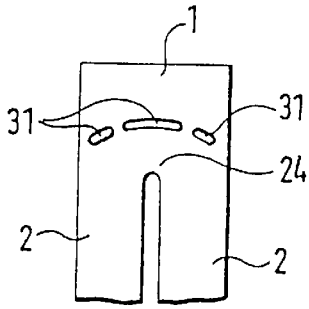
FIG. 21
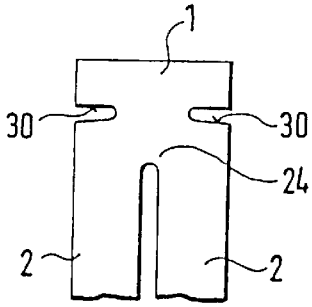
FIG. 20
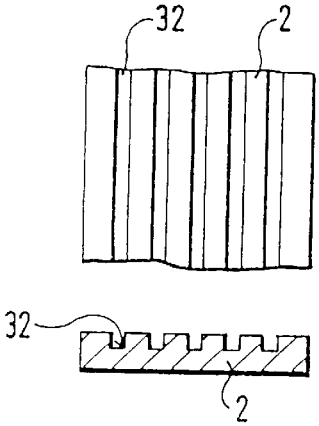
FIG. 22
FIG. 23
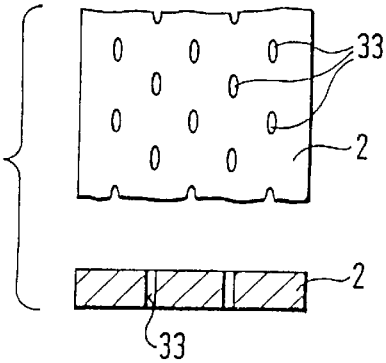

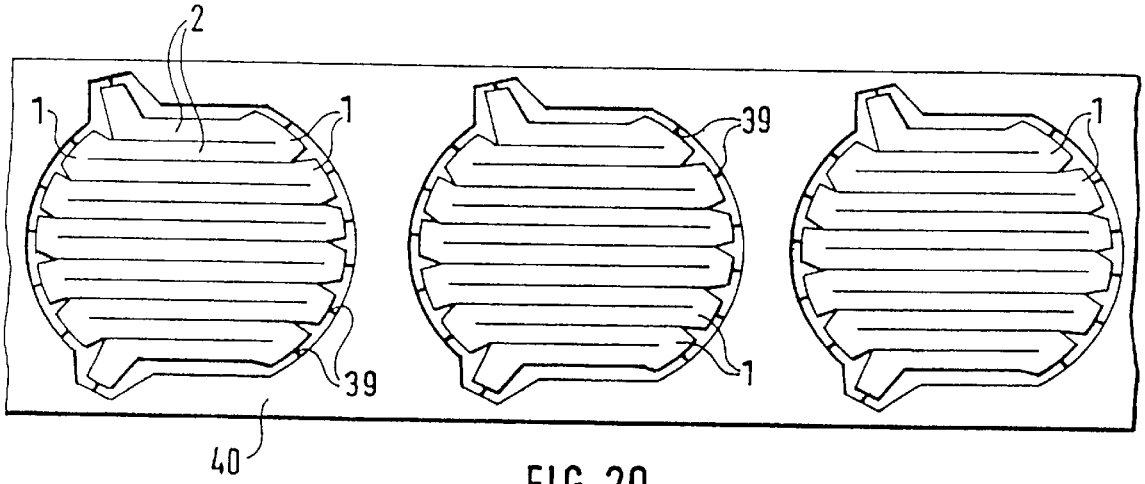
FIG. 29
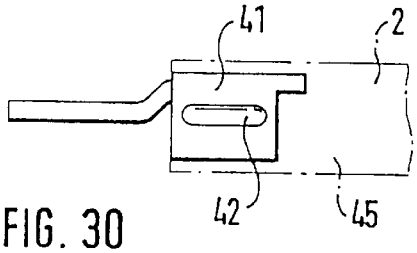
FIG. 30
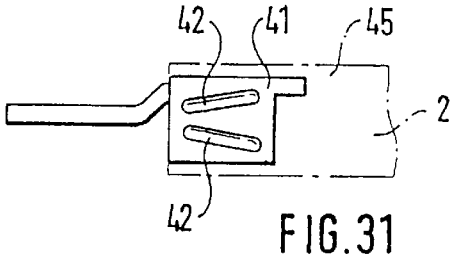
FIG. 31
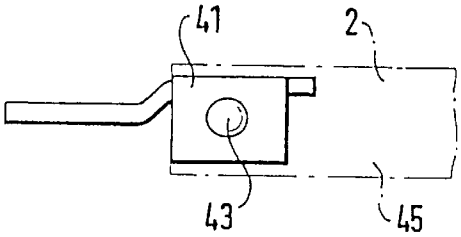
FIG. 32
FIG. 33
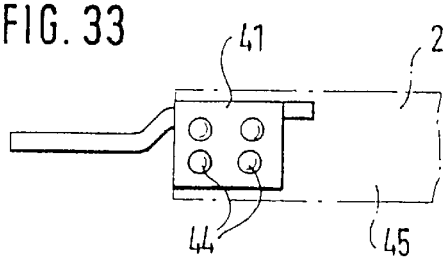
FIG. 34
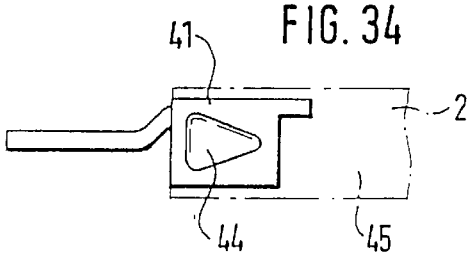

HEATING CONDUCTOR FOR RADIANT HEATING BODIES OF A COOKING HOB

The invention concerns a heating conductor for radiant heating bodies of a cooking hob as set forth in the classifying portion of claim 1. Heating conductors comprising a flat strip or band are already disclosed in DE 42 29 375 A1 and EP 0 585 538 A2. In those two publications the desired geometrical pattern of the heating conductor is formed by the flat strip being laid in suitable turns or windings on an insulating bottom of the radiant heating body. The large surfaces of the adjacent flat strip portions face towards each other while only the narrow edges of the flat strip are directed towards the cooking hob itself. That means that such a flat strip which is laid in a geometrical pattern is disposed upright in an on-edge position and is to be fixed on the insulating bottom of the radiant heating body by a particular clipping arrangement. The clips which are fitted in succession at short spacings form portions of low electrical resistances, which make themselves perceptible in a negative fashion in terms of the incandescent configuration or image produced on the hob. As heat radiation occurs substantially laterally from the flat strip, no direct radiant heating effect occurs. For, the narrow edges which are towards the cooking hob cover only a very small part of the area thereof.

EP 0 175 662 B1 discloses a heating conductor with a geometrical pattern which is formed by stamping out of a metal foil or sheet. That heating conductor however is only suitable for temperatures up to a maximum of 400° C and for that reason alone cannot be used for a radiant heating body. Such a heating conductor is installed in vehicle seats where bendability of the heating conductor is not wanted.

Heating conductor tracks using a flat conductor technology, preferably a thick-film paste technology, are also already known from EP 0 229 928 A2 for heating elements of cooking appliances. Such thick-film paste conductor tracks are applied to a carrier element which is stable in respect of shape. That publication does not describe a radiant heating body in which incandescence of the heating conductor track is the important consideration.

The object of the invention is to provide a heating conductor for a radiant heating body of a cooking hob of the kind set forth in the opening part of this specification, which can be easily mounted over the insulating bottom of the radiant heating body by simple means which reliably ensure that the temperature expansion effects of the heating conductor are absorbed.

The individual features of the structure in accordance with the invention provide heating conductors having heating limbs in various arrangements and configurations. There is also provided a plurality of holding plate portions or tongues for the heating limbs, which make it possible for such heating limbs to be fixed in accurate position in the radiant heating body in a technically simple manner. In that respect an essential feature of the constructions according to the invention is that the novel heating conductors with the holding tongues formed thereon can be industrially manufactured in mass-production and fitted into radiant heating bodies.

Figure 2:
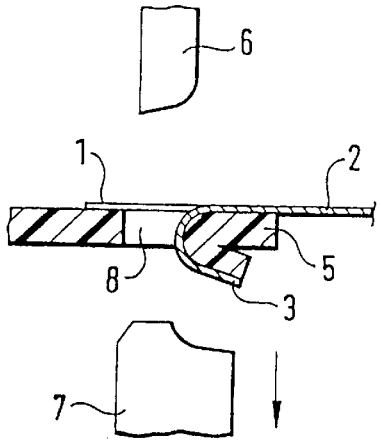
Figure 3:
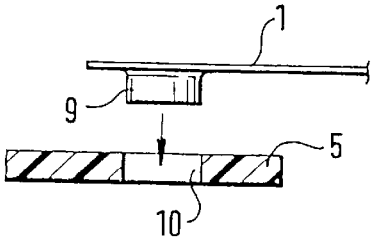
Figure 5:
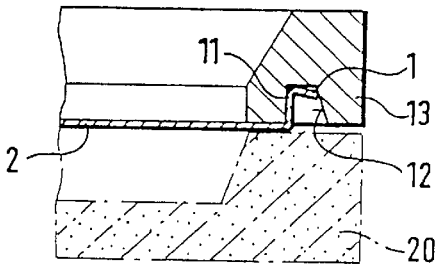
Figure 4:
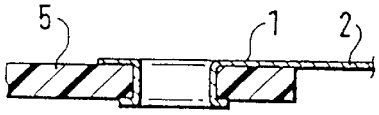
Figure 6:
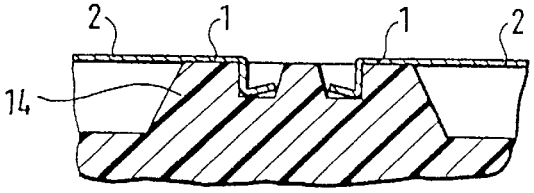
Figure 7:
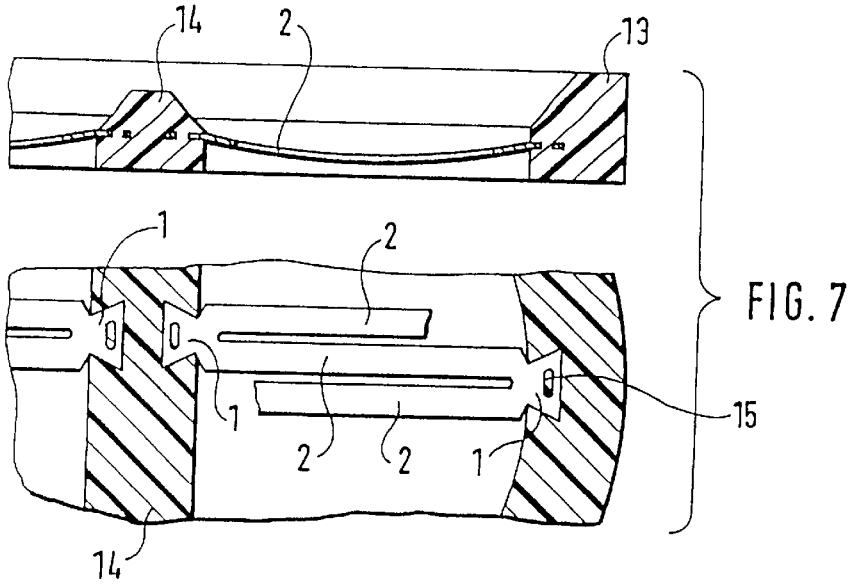
Figure 8:
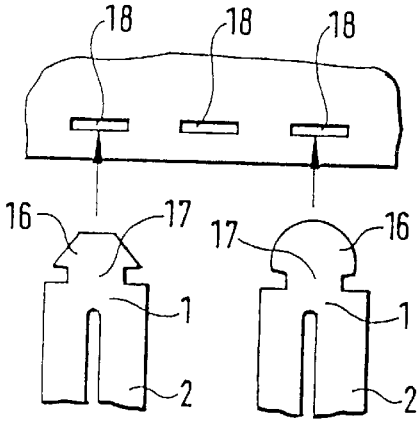
Figure 9:
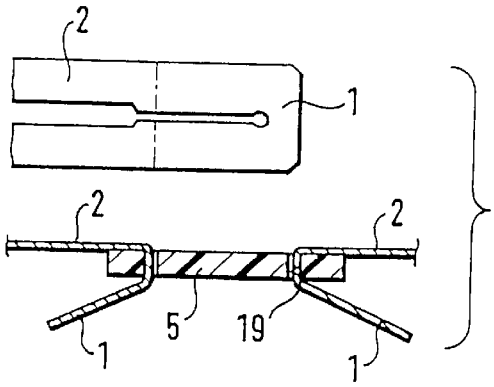
Figure 10:
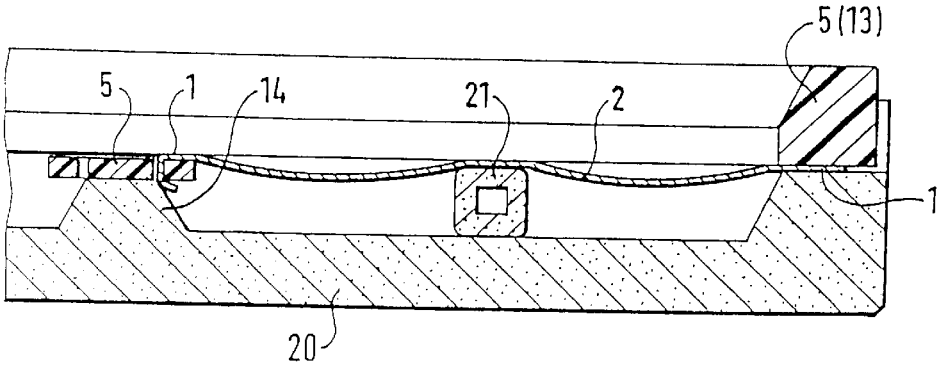
Figure 24:
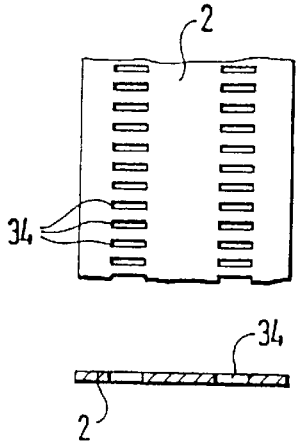
Figure 25:
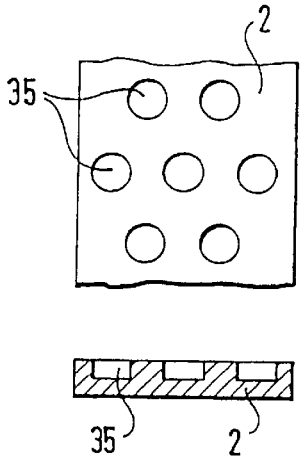
Figure 26:
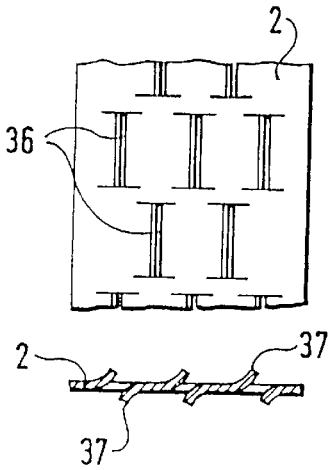
Figure 27:
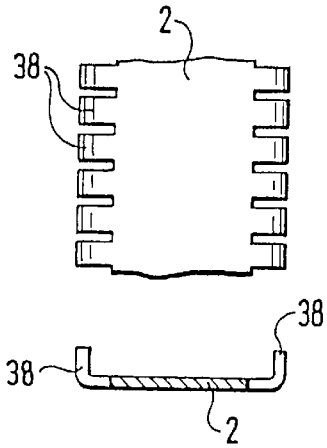
Figure 28:
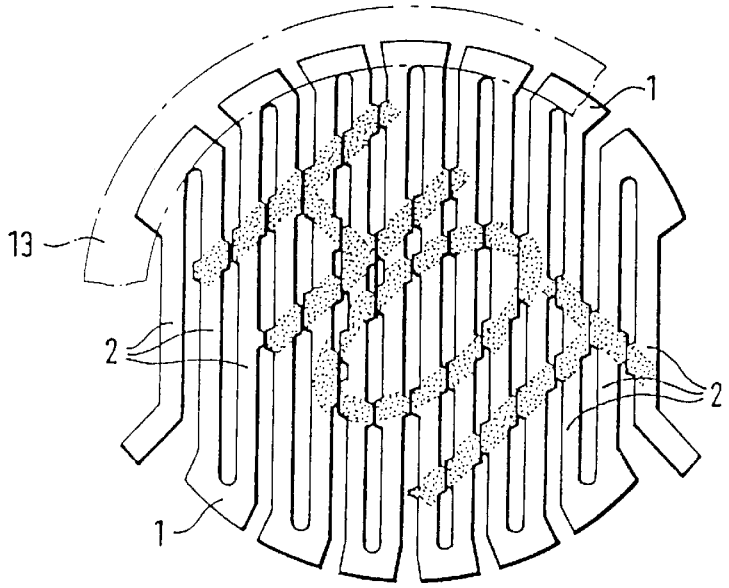

The technical details are set forth and described in the specific description hereinafter. The drawing shows a number of examples. In the drawing:

FIG. 1 is a plan view of a heating limb with a holding plate portion or tongue formed thereon, FIG. 2 shows the holding tongues taken along line II—II in FIG. 1, FIG. 3 shows a holding tongue of another kind, FIG. 4 shows the holding tongue of FIG. 3 in the fully fitted condition, FIG. 5 is a diagrammatically simple view of yet another holding tongue, FIG. 6 shows the holding tongue of FIG. 5 in use in an insulating bottom, FIG. 7 is a plan view of heating limbs with holding tongues of yet another shape in use, FIG. 8 shows a plan view of a further variation of heating limbs with holding tongues formed thereon, FIG. 9 shows yet another variant of a holding tongue for a heating limb, FIG. 10 is a view in section of a heating limb when fitted into an insulating bottom with a support portion, FIG. 11 is a view in section showing a heating limb with a fixing mode using clip technology, FIG. 12 is a view in section of a heating limb with a fixing mode using rivet technology, FIG. 13 is a view in section of a heating limb with holding tongues at the end and using clip technology, FIG. 14 is a plan view of a holding tongue with a normal turn portion, FIG. 15 is a plan view of a holding tongue with a modified turn portion, FIG. 16 is a plan view of a holding tongue with a further modified turn portion, FIG. 17 shows a holding tongue with a turn portion in yet a further variation, FIG. 18 shows a holding tongue with a turn portion in a structure with two current flow paths, FIG. 19 shows a holding tongue with a reduced end portion, FIG. 20 is a plan view of a holding tongue with side incisions, FIG. 21 is a plan view of a holding tongue with openings s, FIG. 22 is a plan view of a heating limb with impressed grooves, FIG. 23 shows a heating limb with openings, FIG. 24 shows a heating limb with openings in a new arrangement, FIG. 25 is a plan view of a heating limb with recesses, FIG. 26 shows a heating limb with bent-away incisions, FIG. 27 is a plan view of a heating limb with cooling lugs, FIG. 28 is a plan view of a heating limb arrangement, FIG. 29 shows a heating limb arrangement with connecting limbs, FIG. 30 shows a contact lug of a heating limb with profiling, FIG. 31 shows a contact lug of a heating limb with another profiling, FIG. 32 shows a contact lug of a heating limb with yet another profiling, FIG. 33 shows a contact lug of a heating limb with another new profiling, and FIG. 34 shows a contact lug of a heating limb with still another new profiling.

In regard to a heating conductor for a radiant heating body of a cooking hob which comprises individual heating limbs which are or were separated or severed out of a metal foil or sheet, particular attention is to be paid to fixing and handling in production and in assembly. The heating limbs are cut out of the metal foil or sheet in such a way that different variations in terms of geometrical patterns are produced in plan view, depending on the respective circumstances involved. Those heating limbs are directed towards the cooking hob with their wide surfaces, that is to say in a plan view on to the geometrical pattern, thereby providing for optimum direct radiant heating. The high temperatures which occur in the heating limbs cause thermal expansion of the heating limbs, which is to be absorbed and accommodated by particular fixing modes in a technically simple and effective manner. If the end points are rigidly connected to the underlying structure, longitudinal expansion manifests itself in terms of the foils or sheets sagging downwardly or bowing.

Referring to FIG. 1 shown therein is a plan view of the holding plate portion or tongue 1 for two heating limbs 2 which are disposed in parallel mutually juxtaposed relationship. A fixing tag or lug 3 is stamped free out of the holding tongue 1 in such a way that it can be bent away out of the plane of the holding tongue 1 by bending about a bend edge 4. Disposed beneath the holding tongue 1 is a holding portion 5. The fixing of fixing lugs 3 to the holding portion 5 is effected by a procedure whereby a stamp or punch 6 with three cutting edges and a rounded edge cuts the fixing lug 3 out of the holding tongue 1 and at the same time also severs three edges out of the subjacent holding portion 5. A suitably shaped bending-over stamp or punch 7 which is moved from below against the fixing lug 3 with the cut-out holding portion 5 causes the holding portion 5 to be bent over, together with the fixing lug 3, in the manner shown in FIG. 2. The bent-over fixing lug includes an angle of <90°. Consequently the fixing lug 3 embraces the resulting edge of the window 8 with an angle of between 0° and 90°. By virtue of that configuration the holding tongue 1 is fixed to prevent it from being lifted off. The fixing lug 3 can be of any selected contour and that contour can already be produced upon production of the geometry of the metal foil or sheet. Alternatively the contour of the fixing lug 6 can be identical to the external contour of the holding tongue 1.

Referring to FIG. 3, a drawn-through collar portion 9 is integrally formed on the holding tongue 1. The collar portion 9 substantially comprises a hollow-cylindrical body of any cross-section but in particular a circular cross-section, which is fitted into a corresponding opening 10 in the holding portion 5. The collar portion 9 is flanged-over by suitable tools on the rear side of the holding portion 5 so that the holding tongue 1 is firmly secured with the heating limbs 2 in the holding portion 5 (FIG. 4).

FIG. 5 is a view in section through an insulating ring 13 which can be fitted on to an insulating bottom 20 (FIG. 10) in a conventional known structural configuration. Provided in the underside of the insulating ring 13 is an annular groove 20 which is of a substantially rectangular cross-section. The wall of the annular groove 12, which is at the outward side of the annular configuration thereof, can preferably extend inclinedly, whereby the bottom of the groove is narrower than the opening thereof. A holding tongue 1 of a heating limb 2 is fitted into the annular groove 12. The holding tongue 1 is of a substantially Z-shaped form and as a result self-lockingly engages into the annular groove 12. It will be appreciated that the holding tongue 1 may also be of different shapes, instead of the Z-shaped configuration illustrated. In addition, as an alternative to the annular groove 12, it is also possible to adopt an individual recess or a plurality of recesses which are arranged in series in mutually juxtaposed relationship and into which the end portion 11 of the holding tongue 1 is inserted. The end portion 11 of the holding tongue can be shaped prior to the assembly operation; however, the operation of shaping the end portion 11 of the holding tongue may also be implemented in the assembly procedure by virtue of pressing the holding tongues 1 into the annular groove 12 (recess) by means of a suitable annular punch or stamp.

If a diagonal limb or land 14 (FIG. 6) which connects the insulating ring 13 is provided on the insulating bottom 20 in addition to the insulating ring 13, the holding tongue 1 which terminates in that diagonal limb or land 14 will also be of a Z-shaped configuration and engage into a groove or recess, as is shown in equivalent form in FIG. 6.

Referring to FIG. 7, provided therein are heating limbs 2 which are fitted between an insulating ring 13 and a diagonal limb or land 14 of an insulating bottom. In this case the holding tongues are of a dovetail configuration in plan and engage into corresponding recesses or openings in the insulating ring 13 and the diagonal limb or land 14 respectively. Instead of the dovetail shape the holding tongues 1 may also be of a rectangular or other shape and may have an opening 15 therethrough. Thus the holding tongues 1 may be angled with their ends downwardly (or upwardly), whereby they hook in claw-like engagement in the material, just like the illustrated dovetail configuration. The holding tongues are desirably inserted into the initial material in powder form, which is then pressed by a bottom tool and a top tool. Thus, in the shaping procedure, the ends of the holding tongues 1 are fitted in position and then enclosed by the material.

FIG. 8 shows another mode of fixing. In this case the holding tongues 1 have at their ends so-called push-in or plug-in tongues 16 which in the left-hand embodiment in FIG. 8 are cut out in the form of a trapezium and in the right-hand embodiment in FIG. 8 are cut out in a half-round shape. The push-in tongues 16 are secured to prevent them from being released from the holding portion 5 insofar as they are of a substantially arrow-like configuration with an inclined insertion portion and a barb configuration. The neck 17 of the push-in tongues 16 is the same width as or narrower than a corresponding window 18 in the holding portion 5. In contrast the widest part of the push-in tongue 16 is slightly, for example 0.2 to 1 mm, wider than the window 18. In the push-in procedure therefore the push-in tongue cuts somewhat into the holding portion 5 and is thereby slightly deformed. In the pushed-in condition the enlarged-width portion acting as barb means prevents the push-in tongues 16 from coming loose out of the window 18 in the holding portion 5. The enlarged-width portion or the barb means of the push-in tongues 16 can also be angled over after being inserted into the window 18, which ultimately results in them being positively lockingly held in position.

In FIG. 9 the holding tongues 1 are prolonged in line with the heating limbs 2 and are fitted through openings 19 in the holding portion 5 and are angled in a direction back towards the heating limbs 2. That construction provides an additional heating conductor surface. As a result the heating conductor temperature is reduced for the entire heating conductor so that the radiant heating body can overall be provided with a higher level of electrical output power. The ends of the holding tongues, which are fitted through the openings 19 and bent back, have current flowing therethrough, as far as the end or to close to the outer end, and are incandescent when the heating body is in the condition of being switched on.

FIG. 10 shows that a heating limb 2 of a heating conductor is taken from the integral annular portion of an insulating bottom 20 to the integral diagonal limb or land 14. The holding tongues 1 are fixed in the holding portion 5 and in the insulating ring 13 respectively by one or more of the above-described fixing structures. In order to reduce the extent of bowing of the freely hanging heating limbs 2, the heating limbs 2 are supported in the hot region by a suitable support portion 21. If that support portion is formed by a part of the insulation or by a component which is a poor thermal conductor, then the contact surface with which a hot heating limb rests on the support portion 21 is advantageously small in order not substantially to interfere with the heat emission of the heating limb 2. A small contact surface is afforded for example by line contact or by point contact. In contrast, it is of particular advantage if the support portion 21 is formed from a material which enjoys good thermal conductivity. The support portion 21 carries away the heat of the heating conductor by way of the contact surface and thus protects the heating conductor from overheating at the support location. By virtue of a suitable design configuration for the support portion 21, it gives off the received energy to the internal space of the heating body. In particular quartz glass or ceramic can be used as preferred materials for the support portion.

A further fixing mode is afforded by a clip 22 which is bent in a U-shape and which, as shown in FIG. 11, is shot through the holding tongue 1 and the holding portion 5 which is disposed therebeneath, and which is bent over at the respective ends where they issue therefrom. If the holding portion 5 is annular or is formed with a diagonal limb or land 14 then the outer and inner holding tongues 1 can also be fixed in the insulating ring 13 in the same manner.

Instead of the clip or staple 22, as shown in FIG. 12 the holding limb can also be joined to the holding portion 5 by a rivet 23. It is further also possible to use nails, screws or the like fixing means for mounting the holding tongue 1 on the holding portion 5.

FIG. 13 shows the fixing of the holding tongues 1 by clips or staples 22 directly on to the annular edge or insulating ring 13 and the diagonal limb or land 14 of the insulating bottom of the radiant heating body.

The holding tongues 1 form in known manner and, as described above, the one-sided connection of at least two heating limbs 2 which extend in mutually parallel relationship. The region of the holding tongue 1 which represents the electrical connection of the two adjacent heating limbs involves a critical region, in the case of most possible incandescent patterns. As the electron flux endeavours to follow a flow path of the lowest electrical resistance, a point of local overheating of the heating conductor occurs at the inner region of a turn portion or return loop portion 24, due to concentration of the current flow. Such overheating can have a damaging effect on the heating conductor material structure. The large thermal gradient within the holding tongue 1 also causes thermal stresses which can result in crack formation in the heating limb 2 or in the holding tongue 1.

FIG. 14 shows an example of a simple holding tongue 1 with two connected heating limbs 2 without particular measures to prevent overheating.

FIG. 15 now shows an enlarged surface area for the holding tongue 1 by virtue of the heating limbs 2 being increased in width on one side from approximately the transition from the heating limbs 2 to the holding tongue 1. That increase in width as indicated at 25 in a radial outward direction from the turn portion 24 provides that the current flow from the heating limbs 2 is displaced somewhat outwardly in the region of the holding tongue 1. In addition those increased-width portions 25 have the effect of dissipating heat.

An enlarged-width portion 24 with an increase in the radius thereof, as shown in FIG. 16, reduces the difference in resistance between the innermost notional current flow path and a further outwardly disposed notional current flow path, around the holding tongue 1. The concentration of the flow of current at the inner edge of the portion 24 thereby markedly falls. The embodiment shown in FIG. 16 is of particular advantage in combination with the enlargement configuration as indicated at 25 in FIG. 15.

Suitable stamping-out or etching produces in the region of the portion 24 of the holding tongue 1 a cooling tag or lug 26 which does not have the current flowing therethrough or which has only a very small amount of current flowing therethrough and which carries heat directly away from the region of the highest level of energy density. Instead of such an individual cooling lug 26 it will be appreciated that it is also possible to provide a plurality of cooling lugs along the inside contour of the turn portion 24. Such a cooling lug 26 can remain in the plane of the holding tongue or however it can be angled upwardly or downwardly.

FIG. 18 shows that the portion 24 of the holding tongue 1 is geometrically divided into an inner current flow path 27 and an outer current flow path 28. In that arrangement the inner current flow path 27 is also artificially prolonged by an additional meander configuration. Those features provide for an increase in the resistance of that inner current flow path, the current flow itself decreases and as a result the level of thermal loading is not higher than that of the other regions, for example of the heating limbs 2. Any change in the direction of the current flow at another location, for example also a change in direction through 90° to a connecting path, can be toned down or alleviated by such a measure.

The reduction in the dissipation of heat within a holding tongue 1 overall provides for a homogeneous temperature distribution in the region of the portion 24. The temperature gradient decreases and there are scarcely any temperature-induced stresses in the entire heating conductor with heating limbs 2 and holding tongues 1. In order to reduce the dissipation of heat the holding tongue 1, as shown in FIG. 19, is provided at its end with a reduced or narrowed end lug portion 29. Instead of such a reduced or tapered end lug portion 29 the conduction of heat is also reduced by cut-in incisions 30 or by a row of holes 31 with a plurality of successively arranged perforations. It will be appreciated that the holding tongue geometry may also be afforded by a combination of the arrangements described with reference to FIGS. 19, 20 and 21.

If heating limbs 2 with holding tongues 1 are made from a metal foil or sheet by etching on both sides, there is then in principle the possibility of making such heating limbs 2 thinner than the holding tongues 1 with the portions 24. For that purpose the metal foil or sheet is etched over an area in the region of the heating limbs 2 from one side. By virtue of embossing or stamping the heating limbs 2 or by partially thinner rolling of the metal foil or sheet in the region of the heating limbs 2, a difference in thickness is achieved between the heating limbs 2 and the holding tongues 1. The holding tongues 1 then remain in the original material thickness of for example 0.12 mm of the metal foil or sheet. The heating limbs 2 on the other hand are reduced to a material thickness of about 0.06 mm. Such heating limbs 2 are more stable at their end at which the greatest flexural loading also occurs. The above-discussed problem of overheated points in the turn portions is alleviated for the turn portions now involve a relatively thick gauge of material.

The positive effect referred to above can also be achieved by the portions 24 being increased in cross-section by a suitable application of material, for example galvanically or by laser build-up welding.

The surface of the heating limbs 2, which radiates heat in the direction of the cooking hob, is increased as shown in FIG. 22 by virtue of the fact that longitudinal grooves 32 are etched or impressed on the surface which is towards the cooking hob, with the grooves 32 terminating before the end region, that is to say before the turn portions 24. As a result the turn portion region is of a thicker material cross-section and the points in the portion 24 heat up to a substantially lesser degree, whereby the durability of the heating conductor generally is increased.

FIGS. 23 to 26 describe an increase in the resistance of the heating limbs 2 by a reduction in the resulting cross-section, which is afforded for example by introducing a pattern of holes. That generally produces an increase in the length of the current flow paths in the heating limbs 2. In addition the heat-radiating surface area is increased by virtue of such perforations. The heating limbs 2 are wider than usual and the overall heating conductor length decreases. As a result the entire heating conductor geometry comprises only a few limbs, and that also signifies less dead area which is required for safety spacings. That arrangement in turn affords an enlarged heatable surface which reduces the heating conductor temperature. As shown in FIG. 23 approximately oval holes 33 or openings are provided in the heating limb 2. The holes 34 in the heating limb 2 shown in FIG. 24 on the other hand are of a substantially rectangular cross-section. As shown in FIG. 25, larger circular recesses or blind holes 35 are provided in the heating limb 2. In FIG. 26 the heating limb 2 has incisions 36, the cut edges 37 of which are bent slightly upwardly or downwardly. It will be appreciated that the holes and recesses in the heating limbs may also be of other cross-sections, for example square, rhomboidal or the like suitable shapes. It is also possible to implement other arrangements of the holes or recesses 33, 34, 35 and 36 in the heating conductor 2. As the Figures show the holes can be in the form of through holes extending through the heating limb or they may also form recesses or depressions 35 which for example are etched therein only halfway through same. In the case of the heating limb 2 shown in FIG. 26, the original heating conductor cross-section is retained, with an enlarged radiating surface area.

Small cooling lugs or tags 38 which do not have current flowing therethrough and which are provided along the outside edges of the heating limbs 2 reduce the heating conductor temperature. In order to increase the safety spacing relative to adjacent heating limbs 2 the cooling lugs 38 are advantageously bent or angled upwardly or downwardly, as is shown in FIG. 27.

In the case of a dual-circuit radiant heating body with a central small cooking area or cooking zone and an outer cooking area or cooking zone which can be additionally switched on, the current connections of the inner heating zone necessarily extend through the region of the outer heating zone. By virtue of a suitable design in respect of width of the heating limbs 2 it can be provided that in operation of only the inner zone, the current connections remain below the incandescent temperature. Upon operation of the two heating circuits, the heating limbs 2, due to the increased internal space temperature in the outer zone, assume a temperature which is perceived as incandescent. That provides that the outer heating zone has a highly homogeneous incandescence image or configuration, without dark locations which usually occur by virtue of the inner zone connections necessarily passing therethrough.

Optimisation in regard to the increase in size of the radiating surface of the heating limbs and at the same time a reduction in the number of fixing locations or holding tongues 1 is achieved if the heating limbs 2 rest on the peripherally extending insulating ring 13 with their holding limbs 1 without reversal points in the inner region, for example due to the use of a diagonal limb or land 14, as is shown in FIG. 28. If it is found to be necessary, the heating limbs 2 are supported at one or more locations by support portions 21. The heating limbs 2 can be slightly enlarged in their cross-section in the support region in order to reduce the heat output in that region and therewith the temperature of the metal foil or sheet.

The state of the art and the previously described illustrations only ever show that the heating limbs 2 which are etched or stamped out of a metal foil or sheet or the corresponding geometrical pattern of the heating conductor is arranged in a plane under the cooking hob. It is however also possible, and this is embraced by the scope of protection of the invention, for the heating limbs 2 to be arranged at different heights one above or one below the other. In order to take up less space for fixing of the heating limbs 2, the holding tongues 1 are disposed for example at different heights for the purposes of fixing to the diagonal limb or land 14. As a result there is more space available for the actual heat radiation surface and the heating element temperature falls. The heating limbs 2 which are arranged at different heights generally do not form such a dense surface as in the case of a simple flat arrangement. As a result convection in the internal space of the radiant heating body is promoted, and that also signifies that the heat produced at the heating limb 2 is transported away in a better fashion. The different heightwise arrangement can involve the fixing positions of the holding tongues 1 both in the edge region 13 and also in the inner region 14. This arrangement at different heights can also be combined with the above-described advantageous possible arrangements of the heating limbs 2.

An arrangement of the heating limbs 2 at different heights can also be implemented by arranging two or more heating limbs in two or more different heating conductor planes. In that case the directions of the heating limbs 2 of the different metal foils or sheets may be parallel, perpendicular or at another angle to each other. Such a structure affords substantial advantages in terms of radiant heating bodies with a high level of output power and a high level of power density. The arrangement of for example three metal foils or sheets or heating limbs in mutually superposed relationship affords the possibility of constructing a seven-stage radiant heating body of known kind by a combination of individual, parallel and series connections.

By virtue of the fact that the temperature of a heating limb 2 or a portion of heating limbs 2 falls with an increasing width of the heating limbs 2, there is the possibility as shown in FIG. 28 of producing a so-called light-dark pattern on the heating conductor foil. That technology is utilised in order to provide that feed line and fixing portions are non-incandescent. In an incandescence pattern which covers a surface area, with for example parallel interconnection of all heating limbs 2, the desired light-dark pattern is then afforded by local dark locations in the heating limbs 2 (enlargement portions). With a suitable arrangement of such local dark locations it is possible to represent letters, logos and the like patterns in the incandescence image or configuration, for example the word 'HOT', thereby at the same time expressing a warning that the cooking hob is hot.

Usually thin transverse connections are provided between the individual holding tongues 1, which serve to increase the stability of the heating conductor during the production procedure and assembly. Such connections are mechanically severed or electrically burnt away, after completion. A feature of the invention now involves glueing a stable, self-adhesive and heat-resistant cloth or fabric laminate on to the holding tongues 1 and thereby interconnecting the holding tongues 1. As the connections by way of the laminate are electrically insulating the laminate can remain on the holding tongues 1 and also provides for stability during operation of the assembly. It prevents holding tongues 1 which are in mutually closely adjacent relationship from moving towards each other or touching each other. As a result the heating conductor, even after operation, forms a stable unit which can be handled if required.

In the case of a heating conductor structure which is produced by an etching procedure, a self-adhesive and etching-resistant plastic foil or sheet is advantageously already laminated on one side of the metal foil or sheet, prior to the etching operation. The metal foil or sheet for the subsequent heating conductor is then coated only on one side with etching resist and is etched only on one side thereof. The holding foil or sheet which is laminated thereon remains on the etched foil or sheet until it is securely mounted in the radiant heating body by fixing arrangements.

An alternative to that construction is shown in FIG. 29.

Thin transverse connecting limbs 39 at the outwardly disposed holding tongues 1 extend to the initial strip material 40 for production of the heating conductors from a metal foil or sheet. In the case of this production process the heating conductor geometry remains in the initial strip until stability and positional security of the heating conductor are guaranteed, by completion. This means that the metal foils or sheets can be handled after the etching or stamping operation in the interconnected strip 40 or in suitably cut sheet portions. During or after the completion operation, such connections to the strip 40 are cut mechanically, chemically, by laser beam or electrically, and the strip waste is removed.

For connecting the heating limbs 2 to the electrical connecting paths for electrical contacting of the heating limbs 2, it has been found when using resistance welding that the quality of the weld between the contact lug 41 of the connecting base portion and the heating conductor connection 45 cannot be controlled or can only be controlled with difficulty, when using conventional flat welding lugs in combination with flat or slightly spherical electrodes. Therefore, as shown in FIGS. 30 to 34, in accordance with the invention, the contact lug 41 is provided with an impressed profile from below. That provides zones involving a different current flow and zones involving a different contact pressure, during the welding procedure. During the welding procedure with the flat electrode, zones with a strong to a weak fusion flux and a desired different weld quality are produced.

The profiling which projects on the contact lug 41 can be in the form of a bead or corrugation or a plurality of beads or corrugations as indicated at 42. The profiling can be in the form of one or more pimples or bosses 43 in different arrangements relative to each other or can be formed by other cross-sectional shapes, for example triangular or rectangular impressed portions 44. The profiles each project about 0.1 to 0.5 mm above the surface of the contact lug 41. The profile edges can extend parallel to the surface of the contact lugs 41. It is however advantageous to provide for an inclined configuration which falls away towards the heating body or different heights in order to acquire the desired zones involving a different fusion flux.

We claim:

1. A heating conductor for a radiant heating body of a cooking hob, substantially comprising heating limbs (2), said heating limbs being formed from a metal foil, said heating limbs (2) having the wide surfaces thereof directed towards the cooking hob, said heating limbs (2) being freely suspended at ends thereof between contact surfaces and selectively interpositioned support portions (21) above an insulating bottom (20) at a spacing from the cooking hob, said heating limbs (2) including holding tongues (1) for fastening said heating limbs in holding portions (5) of said radiant heating body, said holding tongues (1) including turn portions (24) for respectively interconnecting two of said heating limbs (2) and which possess a geometrically configured free end piece projecting out of the plane of the heating conductor, said end piece being inserted into a corresponding deformation in the holding portions (5) of the insulating bottom (13, 14, 20).

2. A heating conductor according to claim 1, characterised in that a central part of the heating conductor (2) which is freely suspended between two end portions rests floatingly on a support portion (21) formed from a thermally conductive material.

3. A heating conductor according to claim 1 characterised in that the holding tongue (1) is increased in width approximately from the region of the turn portion (24) outwardly beyond the side edges of the heating limbs (2).

4. A heating conductor according to one of claim 1 characterised in that the holding tongue (1) is increased in width in the region of the turn portion (24) outwardly beyond the heating limbs (2) and selectively has an inner turn portion radius which is larger than the lateral spacing of the heating limbs (2).

5. A heating conductor according to claim 1, characterised in that the holding tongue (1) has at least one cooling lug (38) in the region of the turn portion (24).

6. A heating conductor according to claim 1 characterised in that the holding tongue (1) has an inner and an outer current flow path (27, 28) in the region of the portion (24).

7. A heating conductor according to claim 1 characterised in that the heating limbs (2) are of a greater material thickness in the region of the turn portions than in the remainder thereof.

8. A heating conductor according to claims 1 characterised in that the end portion (29) of the holding tongue (1) is centrally reduced or has cut-in incisions (30) or one or more holes (31).

9. A heating conductor according to claim 1 characterised in that the heating limbs (2) are provided with surface area-enlarging portions which are selectively provided in the form of longitudinal grooves or longitudinal channels (32), openings (33, 34, 35) of any cross-sectional area and in any arrangement, or incisions (36).

10. A heating conductor according to claim 1 characterised in that the heating limbs (2) are provided with cooling lugs (38).

11. A heating conductor according to claim 10 characterised in that the cooling lugs (38) are selectively angled with their end portions downwardly or upwardly.

12. A heating conductor according to claim 1 characterised in that the heating limbs (2) have narrower or wider limb surfaces at predetermined locations.

13. A heating conductor according to claim 1 characterised in that the heating limbs (2) are integral in a continuous structure and are fixed only to the externally peripherally extending insulating ring (13) of the insulating bottom.

14. A heating conductor according to claim 1 characterised in that there are provided two or more heating limb arrangements at a spacing in mutually superposed relationship.

15. A heating conductor according to claim 1 characterised in that the holding tongues (1) are fixed at different heights in the holding portions (5).

16. A heating conductor according to claim 1 characterised in that the holding tongues (1) are connected together by a heat-resistant cloth laminate, a holding foil or the like means applied by adhesive.

17. A heating conductor according to claim 1 characterised in that the holding tongues (1) and the entire heating limb (2) are covered in such a way as to cover the surface area thereof by a self-adhesive plastic foil which is applied on one side.

18. A heating conductor according to claim 1 characterised in that the holding tongues (1) have mechanically or electrically severable holding limbs (39) forming a connection with the initial strip material (40) which surrounds the holding tongues (1).

19. A heating conductor according to claim 1, characterised in that the heating limbs (2) are connected at their ends to contact lugs (41) which are selectively provided in contact lug surfaces thereof with profiling means in the form of beads or corrugations, or pimples (42, 43, 44).

20. A heating conductor according to claim 1, characterised in that, in a dual-circuit radiant heating body, the heating limbs (2) are of a width to enable electrical current connections to remain below an incandescent temperature upon operation only of an inner zone of the cooking hob, while upon operation of the inner and outer zones of the cooking hob the electrical current connections assume an incandescent temperature.

21. A heating conductor according to claim 1, wherein said geometrically configured end piece of the holding tongue (1) is in the form of a push-in tongue (16) and at a head end thereof is provided with lateral inclined insertion portions and possesses a constricted neck (17) which latches into corresponding openings (18) in the holding portion (5).

22. A heating conductor according to claim 1, wherein the geometrically configured end piece of the holding tongue (1) includes a fixing lug (3) which is bent out of the plane of the holding tongue (1) about the holding portion (5).

23. A heating conductor according to claim 22, wherein the holding portion (5) is at least partially bent over together with the fixing lug (3).

24. A heating conductor according to claim 1, wherein the geometrically configured end piece of the holding tongue (1) is selectively Z-shaped or S-shaped and self-lockingly engages into a corresponding recess or groove (12) in the holding portion (5, 14, 13).

25. A heating conductor according to claim 1, wherein the geometrically configured end piece of the holding tongue (1) includes a collar portion (9) which extends tubularly from the planar of the holding tongue (1) through an opening in the holding portion (5) and is flanged about below the holding portion (5).

26. A heating conductor according to claim 1, wherein the geometrically configured end piece of the holding tongue (1) is provided with an incision extending in parallel with the heating limbs (2) so as to form an elongated turned portion.

* * * * *